US006168047B1

(12) United States Patent
Takamura et al.

(10) Patent No.: US 6,168,047 B1
(45) Date of Patent: Jan. 2, 2001

(54) VENDING MACHINE IN WHICH AN ARTICLE PASSAGE HAS AN EFFECTIVE WIDTH AUTOMATICALLY ADJUSTED IN ACCORDANCE WITH AN ARTICLE SIZE

(75) Inventors: Toshiyuki Takamura, Takasaki; Haruki Sakaguchi, Maebashi, both of (JP)

(73) Assignee: Sanden Corp. (JP)

( * ) Notice: Under 35 U.S.C. 154(b), the term of this patent shall be extended for 0 days.

(21) Appl. No.: 09/228,756

(22) Filed: Jan. 12, 1999

(30) Foreign Application Priority Data

Sep. 29, 1998 (JP) ..... 10-275189

(51) Int. Cl.[7] ..... A47F 1/04
(52) U.S. Cl. ..... 221/303; 221/312 R
(58) Field of Search ..... 221/241, 242, 221/68, 92, 303, 304, 311, 312 R

(56) References Cited

U.S. PATENT DOCUMENTS 6,012,604 * 1/2000 Takahashi et al. ..... 221/312 R

FOREIGN PATENT DOCUMENTS

4155494 * 5/1992 (JP) ..... 221/241

* cited by examiner

*Primary Examiner*—Kenneth W. Noland
(74) *Attorney, Agent, or Firm*—Banner & Witcoff, Ltd.

(57) ABSTRACT

In a vending machine having an article passage which is defined by a pair of side plates (3*b*) and extends in a vertical direction, a spacing member having a first and a second spacer (10, 20) is movably attached to one of the side plates to restrict an effective width of a lower portion of the article passage in a horizontal direction. Cooperated with the spacing member, an article discharge device having a delivery piece (6) discharges a lowermost one of the articles from the lower portion of the article passage. An automatically adjusting arrangement is coupled to the spacing member and makes the spacing member be automatically displaced In accordance with article sizes (R1, R2, R3) of the articles (A, B, C) to adjust the effective width.

4 Claims, 6 Drawing Sheets

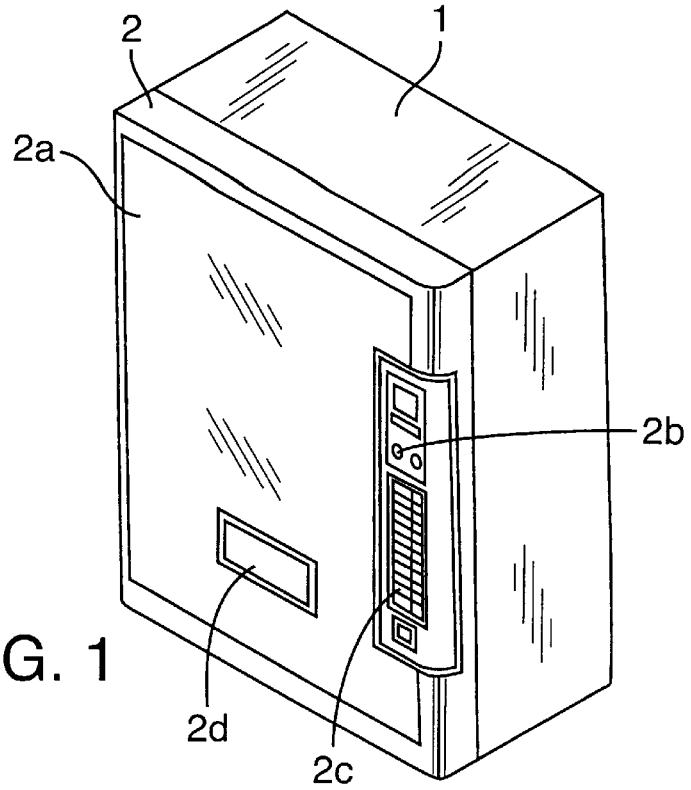
FIG. 1
FIG. 2
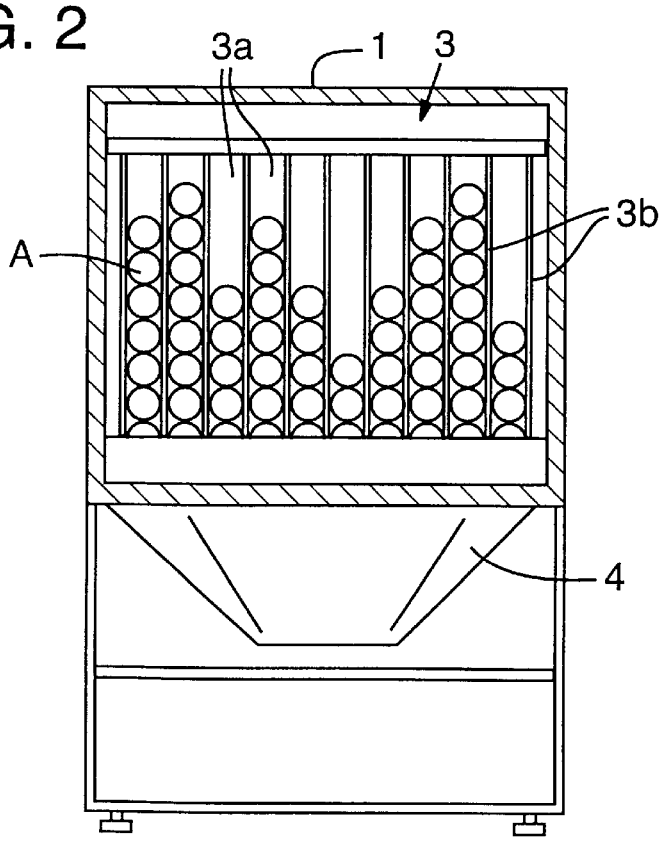

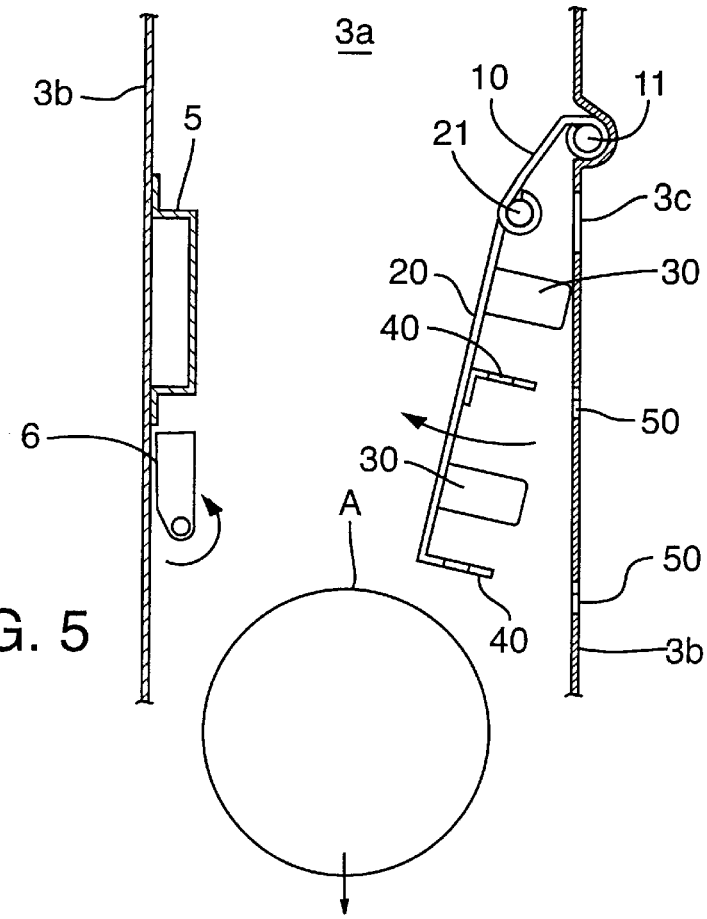
FIG. 5
FIG. 6
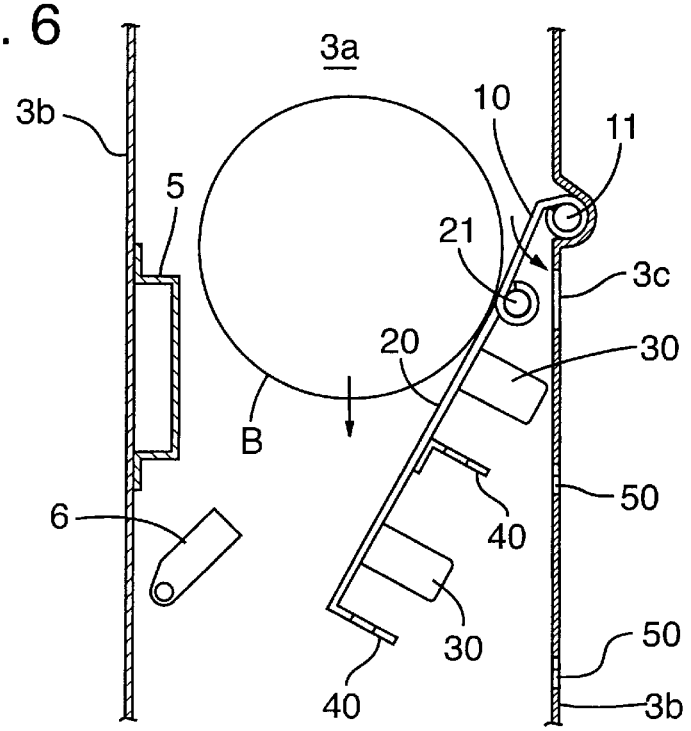

VENDING MACHINE IN WHICH AN ARTICLE PASSAGE HAS AN EFFECTIVE WIDTH AUTOMATICALLY ADJUSTED IN ACCORDANCE WITH AN ARTICLE SIZE

BACKGROUND OF THE INVENTION

The present invention relates to a vending machine for vending articles such as canned, bottled or PET-bottled beverage, and the like.

In a typical one of conventional vending machines, articles such as canned, bottled or PET-bottled beverage are stacked and stored in a vertically extending article passage or storage section. The articles in the article storage section are delivered downward one by one by a delivery mechanism or an article discharge device provided on the lower end of the article storage section. In such known vending machine, when the article to be vended is changed in diameter, the effective width in the article storage section is adjusted in accordance with the diameter of the article, for example, by changing the position of a spacer attached in the article storage section or replacing the spacer with another spacer.

In the conventional vending machine, however, since the spacer position change or replacement is manually performed, the adjustment of the effective width is intricate. Additionally, there is a possibility that the spacer Is attached to an incorrect position or that the spacer for replacement is lost.

SUMMARY OF THE INVENTION

It Is therefore an object of the present invention to provide a vending machine in which it is unnecessary to manually adjust an effective width of an article passage.

Other object of the present invention will become clear as the description proceeds.

A vending machine to which the present invention is applicable is for use in vending articles stacked in an article passage extending in a vertical direction. The vending machine comprises a pair of side plates opposite to each other in a horizontal direction to define the article passage therebetween, a spacing member movably attached to one of the side plates for restricting an effective width of a lower portion of the article passage in the horizontal direction, an article discharge device cooperated with the spacing member for discharging a lowermost one of the articles from the lower portion of the article passage, and automatically adjusting means coupled to the spacing member for making the spacing member be automatically displaced in accordance with an article size of each of the articles to adjust the effective width.

BRIEF DESCRIPTION OF THE DRAWING

FIG. 1 is a perspective view showing a vending machine according to one embodiment of the present invention;

FIG. 2 is a sectional front view of the vending machine;

FIG. 5 is an explanatory view showing the operation of the article storage section of FIG. 3;

FIG. 6 is an explanatory view showing the operation of the article storage section of FIG. 3;

Figure 10A:
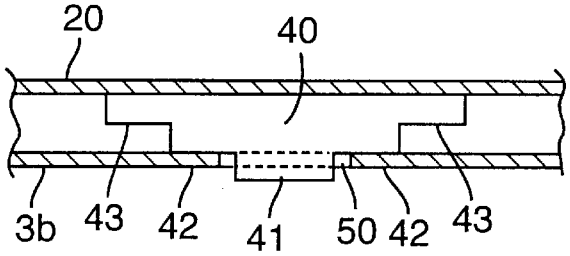
Figure 10B:
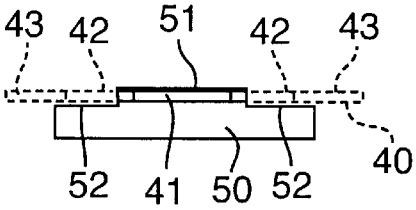
Figure 11A:
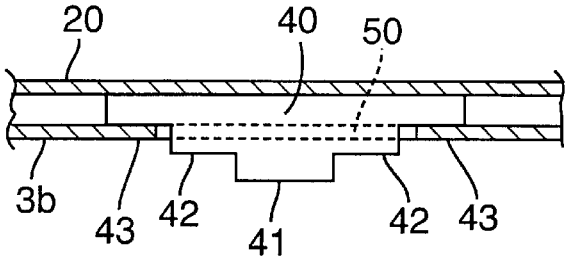
Figure 11B:
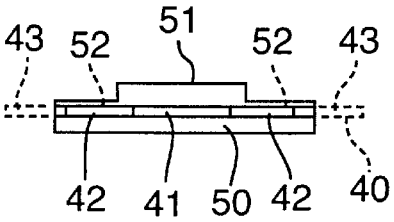
Figure 12:
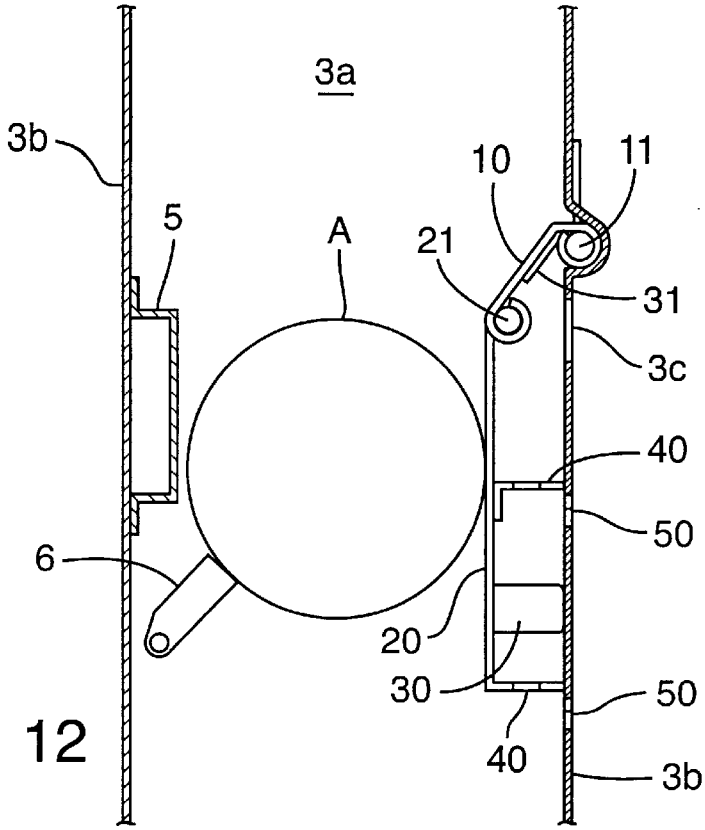
Figure 13:
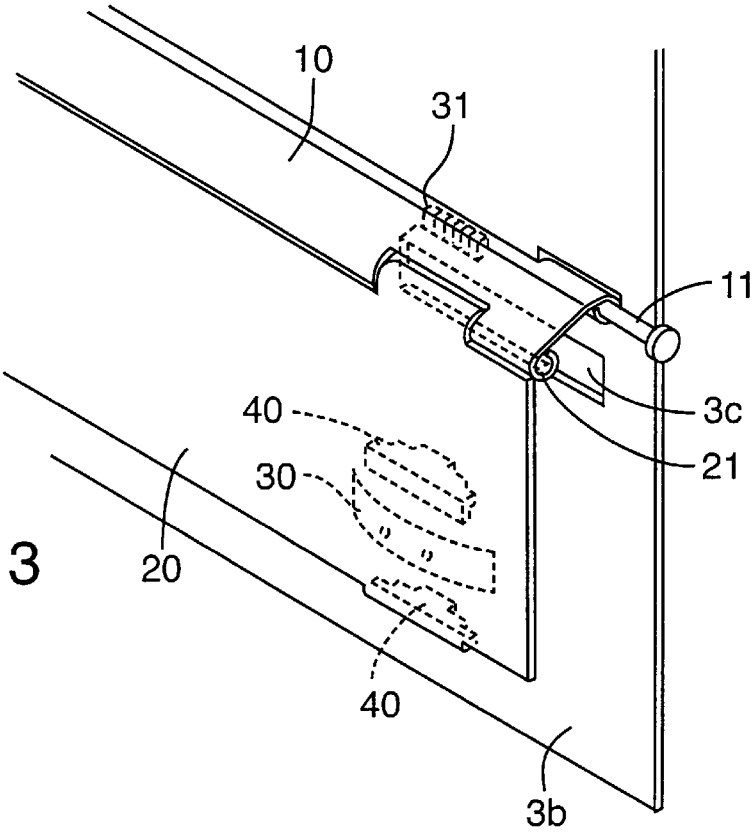

Pigs. 9A and 9B are partially sectional plan and front views showing a first relation between an engaging protrusion and an engagement hole included in the automatically adjusting arrangement;

FIGS. 10A and 10B are partially sectional plan and front views showing a second relation between the engaging protrusion and the engagement hole;

FIGS. 11A and 11B are partially sectional plan and front views showing a third relation between the engaging protrusion and the engagement hole;

FIG. 12 is a front view of an article storage section included in a vending machine according to another embodiment of the present invention; and FIG. 13 is an enlarged perspective view of the article storage section of FIG. 12.

DESCRIPTION OF THE PREFERRED EMBODIMENTS

Referring to FIGS. 1 and 2, description will be made as regards a vending machine according to one embodiment of the present invention.

A vending machine shown in FIGS. 1 and 2 comprises a vending machine body 1 having an open front face, an outer door 2 for opening/closing the front face of the vending machine body 1, and an article storage column 3 provided in the vending machine body 1. Arranged on the outer surface of the outer door 2 are an advertisement display panel 2*a*, a coin slot 2*b*, article selection buttons 2*c*, an article output port 2*d*, and the like. The article storage column 3 has a plurality of article passages or article storage sections 3*a* each extending in a vertical direction. The article storage sections 3*a* are partitioned by a plurality of side plates 3*b*. In other words, the side plates 3*b* are opposite to each other in a horizontal direction to define each of the article storage sections therebetween. Moreover, an article storage width adjustment device described later is provided on the lower end of each article storage section 3*a*.

Specifically, articles A such as canned, bottled or PET-bottled beverage are stacked and stored in each article storage section 3*a* of the vending machine. When the article A of the optional article storage section 3*a* is selected, the lowermost article A in the article storage section 3*a* is dropped downward by a delivery mechanism provided on the lower end of the article storage section 3*a*, and delivered to the article output port 2*d* via a delivery chute 4.

Figure 3:
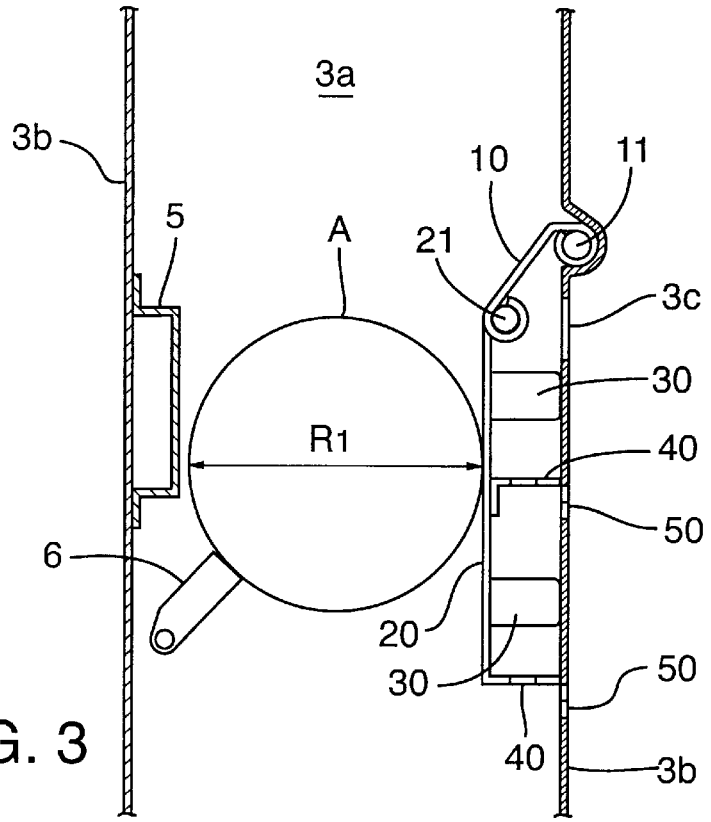
FIG. 3 is a front view of an article storage section of the vending machine.
Figure 4:
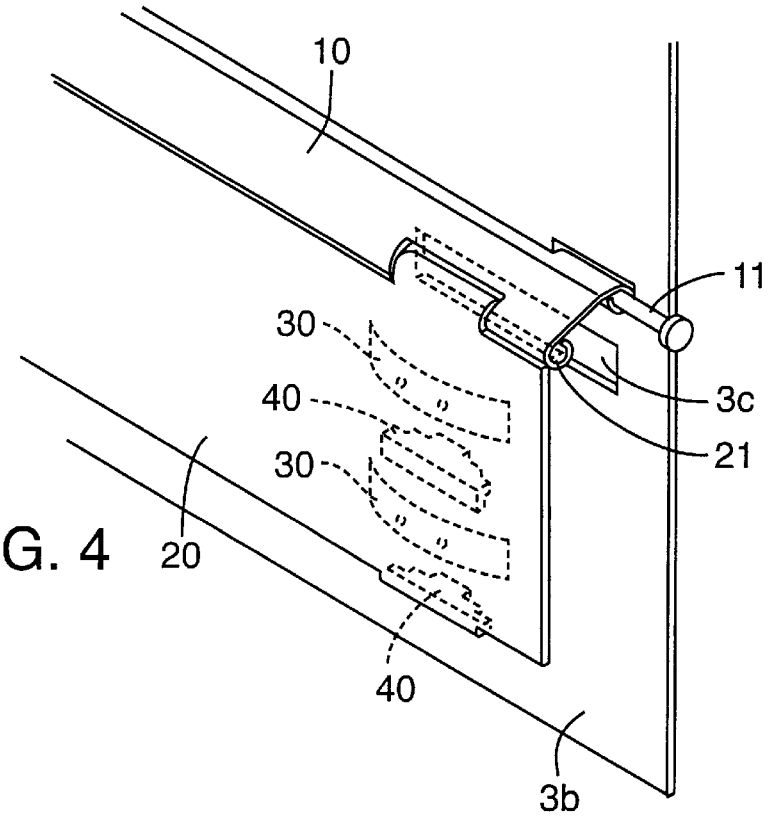
FIG. 4 is an enlarged perspective view of a portion of the article storage section of FIG. 3.

Referring to FIGS. 3 and 4. the description will be made as regards one of the article storage sections 3*a* and the article storage width adjustment device. The article storage width adjustment device comprises a plate-like first spacer 10 having a first end rotatable attached to one of the opposite side plates 3*b* of the article storage section 3*a* via a support 11, a plate-like second spacer 20 having an upper end rotatable attached to a second end of the first spacer 10 via a support 21, and a plurality of springs 30 for urging the first and the second spacers 10 and 20 towards another of the opposite side plates 3*b*. The second spacer 20 is provided with engaging protrusions 40 protruded towards the one side plates 3*b*. In the one side plates 3*b*, engagement holes 50 are formed for engaging with the engaging protrusions 40. Attached to the other side plate 3*b* is a fixed spacer 5 opposed to the first and the second spacers 10 and 20. The delivery mechanism has a delivery piece 6 which is disposed below the fixed spacer 5 and cooperated with the second spacer 20 to discharge the lowermost article A from the lower portion of the article storage section 3*a* in the manner known in the art. This means that the fixed spacer 5 is referred to as an article discharge device. A combination of the first and the second spacers 10 and 20 is referred to as a spacing member for restricting an effective width of the lower portion of the article passage in the horizontal direction.

The first spacer 10 is inclined relative to the vertical direction of the article storage section 3*a*. The second spacer 20 is formed longer than the first spacer 10 and extended along the article storage section 3*a* in the vertical direction. Moreover, formed in one side plate 3*b* is a hole 3*c* into which joining portions of the first and the second spacers 10 and 20 can be inserted.

The springs 30 are attached to upper and lower spots of the second spacer 20 in such a manner that opposite elastically deformable ends of the springs are protruded toward one side plate 3*b*. Each of the springs 30 will be referred to as an urging arrangement.

Figure 9A:
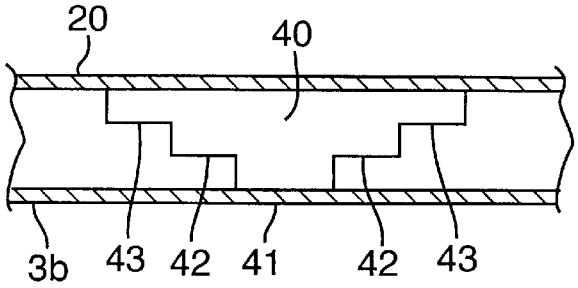

The engaging protrusions 40 are attached to upper and lower spots of the second spacer 20 and extended perpendicularly toward one side plate 3*b* from the second spacer 20. For each engaging protrusion 40, as shown in FIG. 9A, its tip end width is formed narrower in a stepwise manner than a proximal end width. A first step 41, second steps 42 and third steps 43 are formed like a staircase in order from the tip end.

Figure 9B:
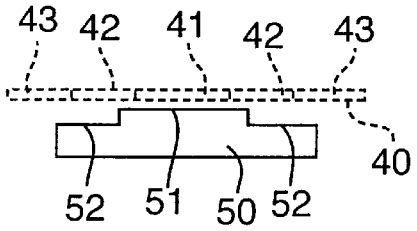

The engagement holes 50 are formed in upper and lower spots of one side plate 3*b*, and opposed to the engaging protrusions 40. For each engagement hole 50, as shown in FIG. 9B, its upper end width is formed narrower in a stepwise manner than a lower end width. A first step 51 and second steps 52 are formed like a staircase in order from the upper end. A combination of each engaging protrusion 40 and each engagement hole 50 will be referred to as a restricting arrangement. A combination of the restricting arrangement and the urging arrangement is referred to as an automatically adjusting arrangement.

In the article storage width adjustment device constituted as described above, as shown in FIG. 3, the second spacer 20 is pressed toward one side plate 3*b* against the springs 30 by contact of the article A in the article storage section 3*a*. As shown in FIGS. 3 and 9B, the first step 41 of the engaging protrusion 40 is engaged on the first step 51 of the engagement hole 50. Thereby, the second spacer 20 is protruded in the article storage section 3*a* by the length up to the first step 41 of the engaging protrusion 40, and the corresponding width in the article storage section 3*a* is regulated in accordance with diameter R1 of the article A.

Subsequently, as shown in FIG. 5, when the delivery piece 6 of the delivery mechanism is rotated to deliver the last article A from the article storage section 3*a*, the spacers 10, 20 are released from the contact with the article A, and rotated toward the other side plate 3*b* by the springs 30. The spacers are then inclined upward relative to the vertical direction of the article storage section 3*a*. Thereby, the engaging protrusions 40 are disengaged from the engagement holes 50.

Subsequently, when an article B having a larger diameter than the article A is thrown into the article storage section 3*a*, as shown in FIG. 6, first the article B abuts on the first spacer 10, and the first spacer 10 is rotated toward one side plate 3*b* by the diameter of the article B. In this case, since the diameter of the article B is larger than that of the article A, the first spacer 10 is rotated downward more than when the article A is introduced.

Figure 7:
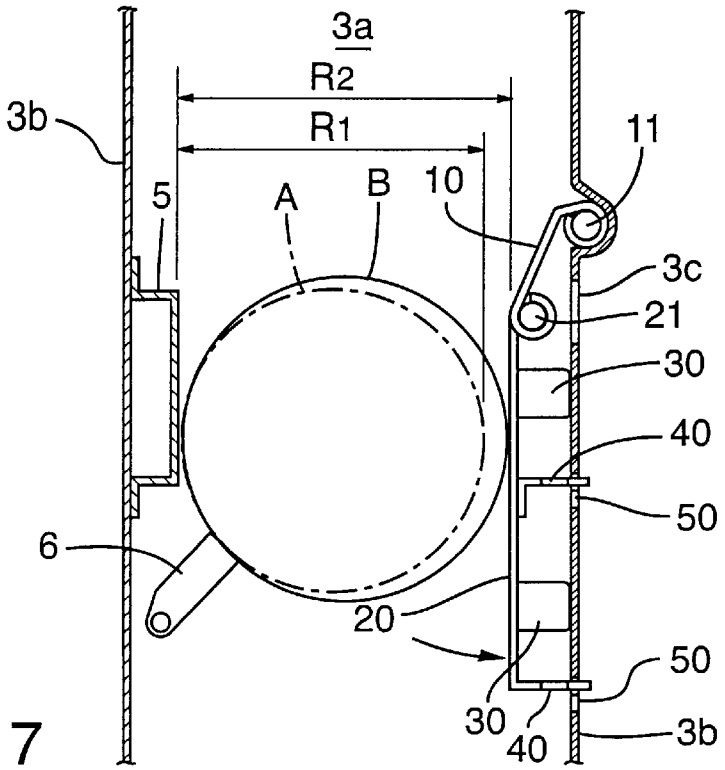
FIG. 7 is an explanatory view showing the operation of an automatically adjusting arrangement included in the article storage section of FIG. 3.

Thereafter, the second spacer 20 is pressed by the article B. and rotated toward one side plate 3*b* around the support 21 on the upper end thereof. As shown in FIG. 7, the article B is held between the second spacer 20 and the fixed spacer 5. In this case, the position of the second spacer 20 is lower because the rotated amount of the first spacer 10 is larger than when the article A is held. Therefore, as shown in FIGS. 7 and 10A, 10B, the first step 41 of the engaging protrusion 40 is engaged in the first step 51 of the engagement hole 50, and the second steps 42 of the engaging protrusion 40 are engaged with opposite edges of the first step 51 of the engagement hole 50. Thereby, the second spacer 20 is protruded in the article storage section 3*a* by the length up to the second steps 42 of the engaging protrusion 40, and the corresponding width in the article storage section 3*a* is regulated (broader than R1) in accordance with diameter R2 of the article B.

Figure 8:
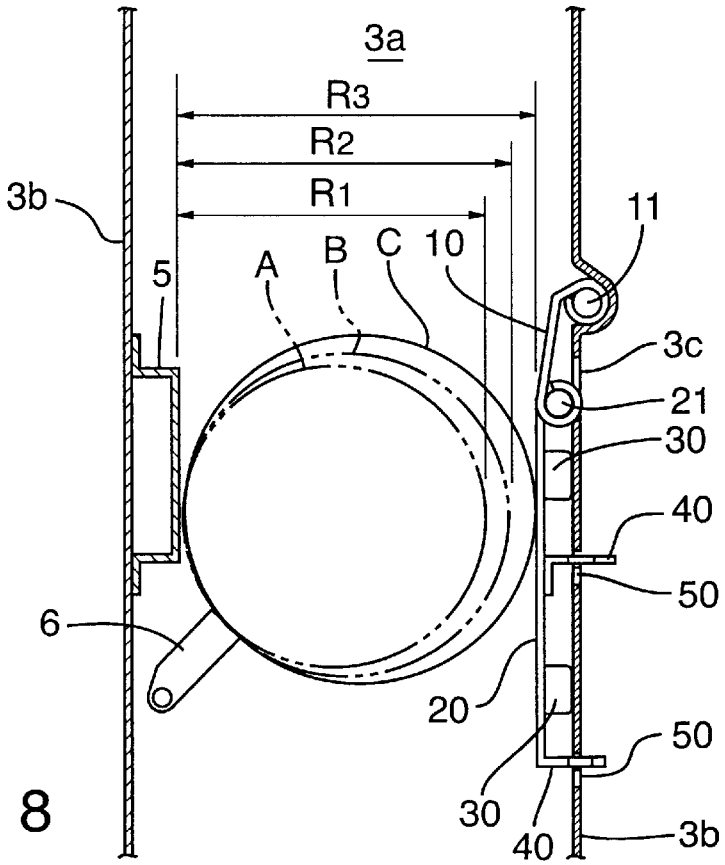
FIG. 8 is a further explanatory view showing the operation of the automatically adjusting arrangement.

Subsequently, when the last article in the article storage section 3*a* is discharged and, as shown in FIG. 8, an article C having a larger diameter than the article B is thrown into the article storage section 3*a*, the first spacer 10 is rotated toward one side plate 3*b* by the diameter of the article C in the same manner as described above. The second spacer 20 abuts on the article C and is then rotated toward one side plate 3*b* around the support 21. In this case, since the diameter of the article C is larger than that of the article B, the first spacer 10 is rotated to a lower position than when the article B is introduced. As shown in FIGS. 8 and 11A, 11B, the first and second steps 41, 42 of the engaging protrusion 40 are inserted in the second steps 52 of the engagement hole 50. and the third steps 43 of the engaging protrusion 40 are engaged with opposite edges of the second steps 52 of the engagement hole 50. Thereby, the second spacer 20 is protruded in the article storage section 3*a* by the length up to the third steps 43 of the engaging protrusion 40, and the corresponding width in the article storage section 3*a* is regulated (broader than R2) In accordance with diameter R3 of the article C.

As described above, the protruded amount of the second spacer 20 from the side plate 3*b* differs in accordance with the engagement positions of the engaging protrusions 40 and the engagement holes 50. Additionally, when the second spacer 20 is released from the contact with the article, the engaging protrusions 40 are disengaged from the engagement holes 50 by the springs 30. When the new article A, B or C is thrown into the article storage section 3*a*, the spacers 10, 20 are rotated by contact of the article. The engaging protrusions 40 and the engagement holes 50 are then engaged in the positions corresponding to the diameter of the new article. Therefore, the article storage width of the article storage section 3*a* can automatically be adjusted just by introducing the article into the article storage section 3*a*. Thus, manual adjustment of article storage width is unnecessary, and much labor can be saved. Additionally, conventional disadvantages caused by incorrectly attaching or losing the spacer can securely be prevented.

Additionally, the springs 30 attached to the upper and lower spots of the second spacer 20 have been described, but as shown in FIGS. 12 and 13, the same spring as the spring 30 of the embodiment may be attached only to the lower spot. In this case, a coil spring 31 for urging upward the first spacer 10 is attached to the support 11 of the first spacer 10.

While the present invention has thus far been described in connection with a few embodiments thereof, it will readily be possible for those skilled in the art to put this invention into practice in various other manners. For example, use may be made of the springs of three or more for urging the second spacer. The spacing member may comprise a first and a second plate portion which are formed integral with and flexibly connected to each other.

What is claimed is:

1. A vending machine for use in vending articles stacked in an article passage extending in a vertical direction, said vending machine comprising:

a pair of side plates opposite to each other in a horizontal direction to define said article passage therebetween;

a spacing member movably attached to one of said side plates for restricting an effective width of a lower portion of said article passage in said horizontal direction;

an article discharge device cooperated with said spacing member for discharging a lowermost one of said articles from said lower portion of the article passage; and automatically adjusting means coupled to said spacing member for making said spacing member be automatically displaced in accordance with an article size of each of said articles to adjust said effective width, said spacing member comprising:

a first spacer having a first end and a second end opposite to said first end, said first end being rotatably connected to one of said side plates; and a second spacer having an upper end and a lower end placed lower than said upper end, said upper end being rotatably connected to said second end of the first spacer, said second spacer being movable in said vertical and said horizontal directions with rotation movement of said first spacer to adjust said effective width.

2. A vending machine as claimed in claim 1, wherein said automatically adjusting means comprises:

urging means coupled to at least one of said first and said second spacers for urging said second spacer towards another of said side plates; and restricting means coupled to said second spacer for restricting movement of said second spacer towards said one of the side plates even when said second spacer is pushed by said lowermost one of the articles.

3. A vending machine as claimed in claim 2, wherein said restricting means comprises:

at least one engaging protrusion protruded from said second spacer towards said one of the side plates; and at least one engagement hole made to said one of the side plates for receiving said at least one engaging protrusion with movement of said second spacer in said vertical direction.

4. A vending machine as claimed in claim 3, wherein said at least one engaging protrusion is formed in such a manner that a tip end width is narrower in a stepwise manner than a proximal end width, said at least one engagement hole being formed in such a manner that an upper end width is narrower in a stepwise manner than a lower end width.

* * * * *